United States Patent [19]

Corbin

[11] Patent Number: 4,949,567

[45] Date of Patent: Aug. 21, 1990

[54] APPARATUS AND METHOD FOR CONTROL OF WIRE CAST AND HELIX

[76] Inventor: Edward W. Corbin, 10854 York Rd., Cockeysville, Md. 21030

[21] Appl. No.: 267,316

[22] Filed: Nov. 4, 1988

[51] Int. Cl.[5] ..... B21F 1/02

[52] U.S. Cl. ..... 72/164; 72/238; 72/160

[58] Field of Search ..... 72/164, 165, 183, 161, 72/162, 238

[56] References Cited

U.S. PATENT DOCUMENTS

| | | | |
|---|---|---|---|
| 1,473,261 | 11/1923 | Thompson . | |
| 2,235,698 | 3/1941 | De Millar | 140/28 |
| 2,511,274 | 6/1950 | Kramer | 117/66 |
| 2,517,309 | 8/1950 | Heller | 72/164 |
| 2,639,758 | 5/1953 | Heller | 72/164 |
| 2,693,219 | 11/1954 | Heller | 72/164 |
| 2,746,513 | 5/1956 | Kiesow et al. | 72/164 |
| 2,856,969 | 10/1958 | Waful | 140/102 |
| 3,286,499 | 11/1966 | Junta et al. | 72/161 |
| 3,343,574 | 9/1967 | Merser | 72/164 |
| 3,548,624 | 12/1970 | Hann et al. | 72/129 |
| 3,595,277 | 7/1971 | Lefever | 140/47 |
| 3,811,309 | 5/1974 | Nordstrom | 72/247 |
| 3,893,316 | 7/1975 | Simich | 72/162 |
| 4,145,904 | 3/1979 | Giros et al. | 72/142 |
| 4,334,418 | 6/1982 | Grandell | 72/164 |

FOREIGN PATENT DOCUMENTS

| | | | |
|---|---|---|---|
| 471919 | 5/1975 | U.S.S.R. | 72/165 |
| 507029 | 6/1945 | United Kingdom | 72/164 |
| 873332 | 7/1961 | United Kingdom | 72/165 |
| 1399907 | 7/1975 | United Kingdom | 72/181 |

OTHER PUBLICATIONS

Sales literature from Sjorgren Tool and Machine Co. Inc., Auburn, Mass.

*Primary Examiner*—Daniel C. Crane
*Attorney, Agent, or Firm*—Leonard Bloom

[57] ABSTRACT

An apparatus consistently imparts a desired cast characteristic and a desired helix characteristic to drawn wire. A set of interchangeable rollers imparts the cast characteristic to the wire in a first plane, and a helix control assembly imparts helix control by shifting the wire leaving the rollers into a second plane. The helix control assembly includes a rotatable sheave and a movable block. The plane in which the sheave resides and to which the wire is shifted is manually controlled by a handwheel. The rollers and the helix control assembly are supported by a common support. The rollers may be mounted in respective universal base plates, a selected one of which is received in an opening in the frame, thereby greatly reducing tooling and maintenance costs and providing improved flexibility in production. Moreover, the rollers include movable rollers interspersed with fixed rollers, wherein the movable rollers may be individually adjusted on either side of the center line of the fixed rollers.

30 Claims, 10 Drawing Sheets

IMPROVEMENT

APPARATUS AND METHOD FOR CONTROL OF WIRE CAST AND HELIX

FIELD OF THE INVENTION

The present invention relates to the field of controlling characteristics of drawn wire, and more particularly to an apparatus for consistent control of the cast and the helix of drawn wire.

BACKGROUND OF THE INVENTION

Metal wire is a material that has a wide variety of uses in many applications. One method of producing wire products involves drawing a wire stock through one or more dies to provide a wire having a desired outer diameter However, in the drawing process, the molecular arrangement of the atoms in the wire may be affected so that the drawn wire product may have certain undesirable characteristics.

More specifically, the drawn wire may not have a desirable "cast". Also, the drawn wire may have an undesirable "helix" characteristic. To one of ordinary skill in the art of wire drawing, the term "cast" refers to the characteristic of a short piece of drawn wire to assume a curved orientation of a specific radius of curvature. Even for drawn wire wound on a spool, if a short piece of the wire were cut from the spool and permitted to sit undisturbed on a flat surface, such as a tabletop, the short piece of wire would inherently curve to a radius of curvature indicative of its "cast".

Also, to one familiar with the art of wire drawing, the "helix" characteristics of the wire may be of great importance. If a short piece of drawn wire is placed on a flat surface, the ends of the wire may lie flat on the surface, or the ends may tend to bend either upward or downward out of the plane of the flat surface. The degree to which the ends of the wire bend out of the plane of the flat surface is referred to as the "helix" characteristic of the wire. If the tendency of the ends of the wire to bend out of the plane of the flat surface is eliminated, then the helix of the wire is said to be eliminated. When the helix is eliminated, the two ends of the piece of drawn wire placed on the flat surface lie in the same plane, and could abut one another if pushed together in the same plane.

Various applications for drawn wire (e.g. for conveyor belts and radial tires) have stringent requirements with respect to the cast and the helix of the wire in addition to the diameter of the wire. More specifically, some applications for drawn wire call for elimination of the helix characteristic. However, conventional wire drawing processes do not provide for consistently eliminating the helix characteristic.

Presently, steps taken to eliminate the helix characteristic of drawn wire are inconsistent and not reproducable. For example, in a production run of drawn wire, at the beginning of the run, a sample of wire may be taken and tested for its helix characteristic. If the helix characteristic is not as desired, then adjustments are made in the drawing or cast control steps to adjust the helix to the desired degree. Once the desired helix is obtained, the production run is continued. However, at intervals during the production run, if new samples are taken and tested for helix, often the helix characteristics will have changed and be out of required specifications. Under present conditions, vast quantities of wire are wasted because of unpredictable and uncontrolled variations in wire helix characteristics of drawn wire. Presently, there is a great need for a device that can provide consistent helix control for drawn wire.

With respect to the characteristic of cast, a drawn wire is often pulled through a series of rollers which impart a desired cast to the wire. Different rollers may be used for different wires. Furthermore, optimum spacing and alignment of the rollers may be attained only after a time-consuming and expensive series of trial and error. So when one wire is substituted for another, a given set of rollers may have to be changed, or a given set of roller alignment and spacing parameters may have to be changed, followed by extensive trial and error to obtain optimum spacing and alignment characteristics for producing desired wire. It would be desirable to be able to change roller sizes, alignment, and spacing without requiring extensive trial and error to obtain desired cast characteristics in drawn wire.

Also, the prior art merely bows the wire and does not consistently (and substantially) break down the molecular structure or composition of the wire, so that the cast of the wire is not uniformly maintained using the prior art method.

SUMMARY OF THE INVENTION

Accordingly, it is an object of the present invention to alleviate the disadvantages and deficiencies of the prior art by providing consistent helix control for drawn wire.

Another object is to provide consistent helix control for drawn wire that is easily adjusted manually by an operator.

Another object of the invention is to provide means to be able to change roller sizes, alignment, and spacing without requiring extensive trial and error to obtain desired cast characteristics.

In accordance with the principles of the invention, a novel apparatus is provided for controlling the helix characteristic of wire drawn from a wire source by means for pulling the wire. The novel apparatus is comprised of: means, located between the wire source and the means for pulling the wire, for guiding the pulled wire in a first plane; and means, located between the guide means and the means for pulling the wire, for selectively exerting forces on the pulled wire in a direction outside the first plane, whereby helix characteristics are controlled.

Preferably, the means for exerting out-of-plane forces on the pulled wire include means for selectively shifting the pulled wire from the first plane to a second plane. The plane shifting means are manually adjustable.

Preferably, the plane shifting means include an assembly comprised of a rotatable sheave and a movable block.

The apparatus of the invention implicitly provides a method for controlling the helix characteristic of drawn wire by employing the steps of: guiding the wire in a first plane; and selectively exerting forces on the wire which are in a direction outside the first plane. Preferably, the wire is shifted from the first plane to a second plane.

The apparatus of the invention also implicitly provides a method for controlling both the cast and the helix characteristics of the drawn wire. This method includes the steps of: guiding the wire in a first plane around a set of rollers, thereby selectively imparting a cast to the wire; and selectively shifting the wire from the first plane to a second plane, whereby the helix characteristic of the wire is selectively controlled.

More specifically, with respect to the sheave and movable block assembly, the sheave includes means for guiding the pulled wire in a selected second plane, and the sheave further includes an opening oriented substantially perpendicular to the second plane. A movable block supports the sheave, and the block includes an opening aligned with the opening in the sheave. A guide is provided for guiding the movement of the movable block. A fastener passes through the opening in the sheave and the opening in the movable block for fixing the sheave to the movable block. The assembly also includes a hollow bolt for securing the sheave to the movable block. The movable block includes an orifice extending from the bottom of the hollow bolt to the bottom of the block.

Manually adjustable means are provided for selectively adjusting the sheave and movable block assembly. The selective adjustment means may include: a threaded shaft; a handwheel connected to the threaded shaft; a stationary block having threads complementary to the threaded shaft; and a threaded adjustment nut located on the threaded shaft below the stationary block. The threaded shaft passes through the hollow bolt, the sheave, the movable block, the adjustment nut, and the stationary block. By turning the handwheel, the threaded shaft is selectively moved up or down with respect to the stationary block, and the adjusting nut respectively pushes the assembly up or permits the assembly to ride down, whereby the sheave is selectively moved outside the first plane.

In accordance with another aspect of the invention, an apparatus is provided for controlling both the cast and the helix characteristics of wire drawn from a wire source by means for pulling the wire. The cast and helix controlling apparatus includes both cast control means operating on the wire in one plane and wire shifting means serving to shift the wire from one plane to a second plane, whereby the helix characteristic of the wire is selectively controlled.

In accordance with yet another aspect of the invention, there is provided (in an apparatus for controlling the cast characteristic of a drawn wire) a universal framework having an opening means formed therein to accommodate a selected one of a plurality of base plates, and means are provided for securely receiving a selected base plate in the opening means in the framework. Each base plate carries a set of rollers having a given size and being arranged in a predetermined configuration. With this arrangement, different sizes or configurations of rollers are provided by the base plates, respectively, thereby providing for reduced tooling and maintenance cost and improved flexibility in production.

In a preferred embodiment, the framework includes a receiving plate having ledges adapted to receive the base plate therein. Preferably, the base plate includes at least one adjustment screw, lying in the plane of the base plate, for adjusting at least one roller along the surface of the base plate.

Preferably, the receiving plate includes at least one channel in registration with the adjustment screw. The channel is capable of receiving means for turning the adjustment screw, e.g. an Allen wrench, when the base plate is in position in the receiving plate.

In accordance with yet still another aspect of the invention, an apparatus for controlling the cast characteristic of drawn wire includes a plurality of sets of rollers and associated base plates. Each set of rollers and associated base plate defines a roller assembly, and the plurality of sets of rollers and respective associated base plates define a plurality of interchangeable roller assemblies. A single framework interchangeably supports each of the roller assemblies, one at a time. The framework includes a receiving plate adapted to receive each of the interchangeable roller assemblies.

The present invention further constitutes an improvement (over the known prior art) in that the movable rollers may be individually and selectively adjusted to extend beyond the center line of the fixed rollers, such that each movable roller may be disposed on either side of the center line of the fixed rollers, as desired. This arrangement and flexibility assures that the molecular structure of the wire may be broken down substantially, thereby assuring that the wire will maintain its desired given cast.

In accordance with a still further improvement of the present invention, a frame is provided having an opening therein; The first and second sets of rollers are mounted on respective base plates; and a selected one of the base plates is adapted to be received in the opening in the frame, thereby providing for reduced tooling costs and improved flexibility in production.

These and other objects of the present invention will become apparent from a reading of the remainder of the specification taken in conjunction with the enclosed drawings.

DESCRIPTION OF THE PREFERRED EMBODIMENTS

Figure 1:
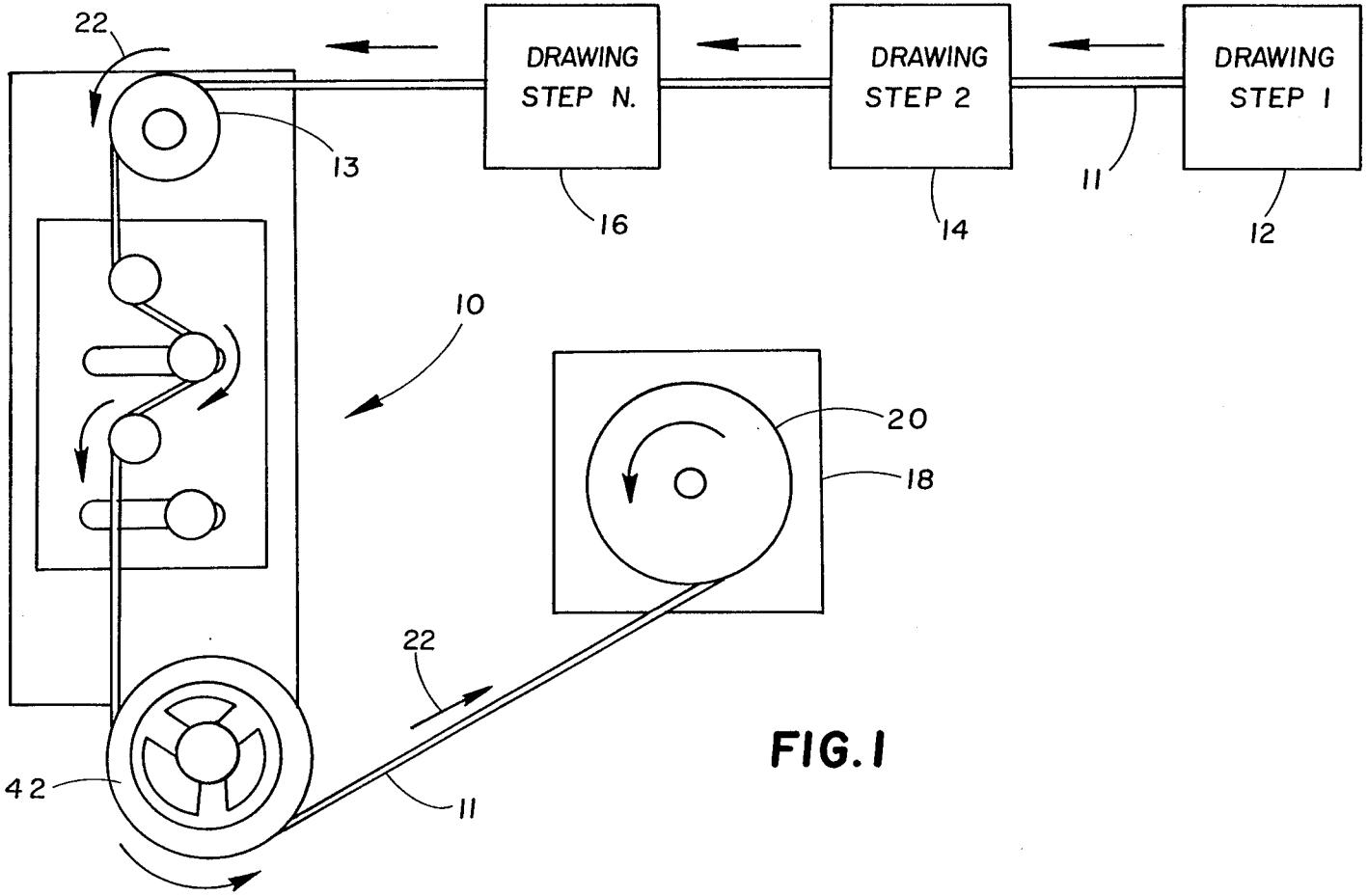
FIG. 1 is a schematic drawing showing the apparatus of the invention used in conjunction with a system of drawing wire.

Referring to FIG. 1, the cast and helix control apparatus 10 of the invention is employed in conjunction with drawing stages 12, 14, and 16 for drawing wire 11. Drawing stages 12, 14 and 16 may be provided with their own means for pulling wire 11 through dies (not shown) in the drawing stages 12, 14, and 16. A finish block 18 includes a spool 20 which is powered by its own electric motor (not shown). The finish block serves to pull the wire 11 through the apparatus 10 of the invention toward itself in the direction of arrows 22.

Figure 2:
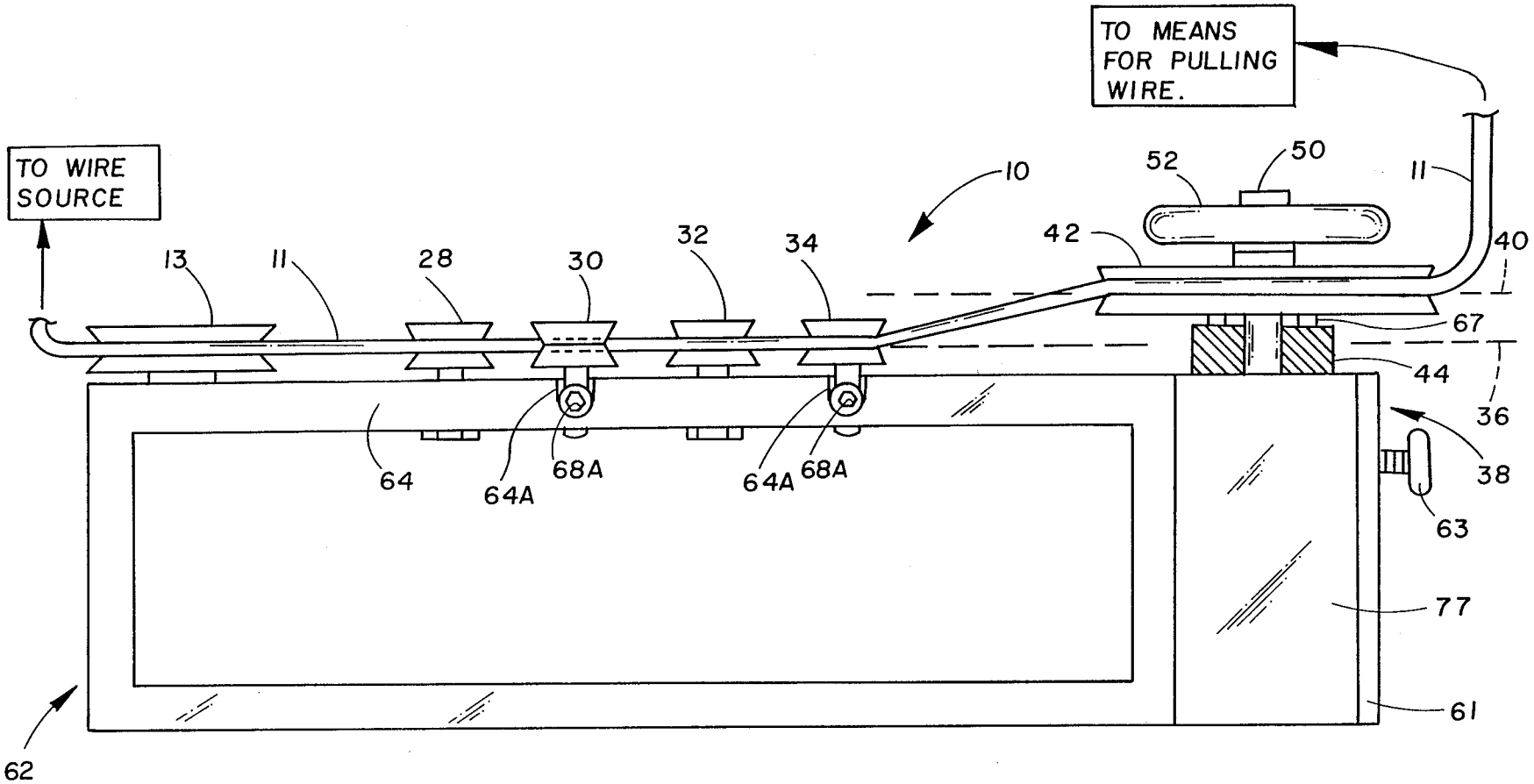
FIG. 2 is a close-up side view of an apparatus of the invention.

With reference to FIG. 2 the embodiment of the apparatus 10 from FIG. 1 is shown in greater detail. For descriptive purposes the last drawing stage 16 in FIG. 1 serves as a source for wire 11 moving to the apparatus 10. Furthermore, the finish block 18 contains the motorized spool 20 and serves to pull the wire 11 through the apparatus 10. A set of cast control rollers 28, 30, 32 and 34 serve as means, located between the wire source and the means for pulling the wire 11, for guiding the pulled wire 11 in a first plane depicted by line 36.

A helix control assembly 38 is located between the guiding rollers 28-34 and the means for pulling the wire 11, for selectively exerting forces on the pulled wire 11 in a direction outside the first plane 36. More specifically, the forces exerted by the helix control assembly 38 pull the wire 11 into a second plane depicted by broken line 40. Even more specifically, rotatable sheave 42 pulls the wire 11 into the second plane 40. Once the helix control assembly 38 is set at the desired second plane 40, a set screw 63 is turned to lock the helix control assembly 38 in the desired setting.

Figure 3:
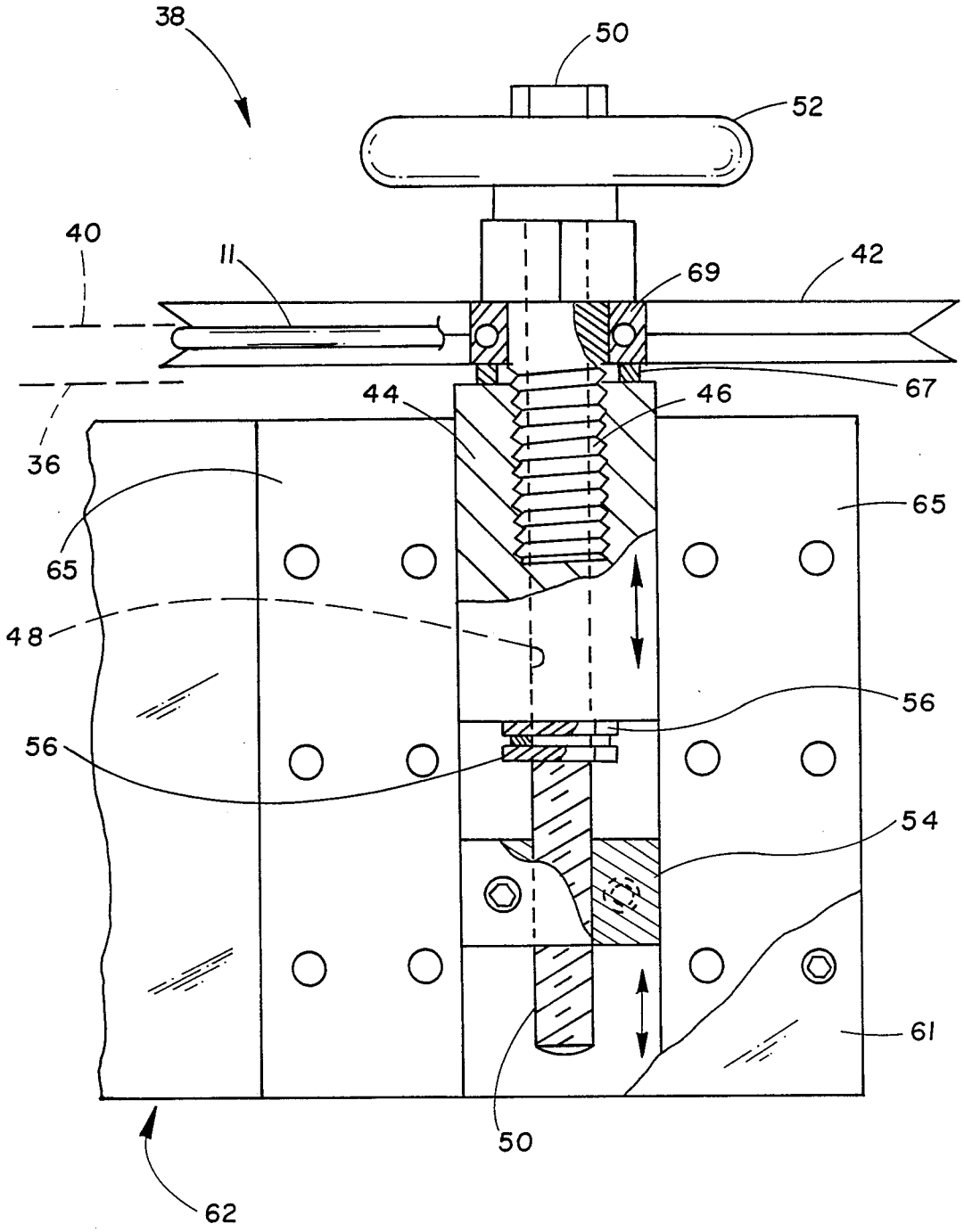
FIG. 3 is an enlarged end view of the apparatus of FIG. 2 having a cover plate removed and showing a manually adjusted mechanism for adjusting the helix controlling sheave.

Referring to FIG. 3, the cover plate 61 and set screw 63 shown in FIG. 2 have been removed and details of the helix control assembly 38 are shown. More specifically, the helix control assembly 38, which serves to shift the plane of the wire 11, includes an assembly comprised of a rotatable sheave 42 and a movable block 44 and means for selectively adjusting the location of the assembly. The sheave and block assembly includes a hollow bolt 46 securing the sheave 42 to the movable block 44. The movable block 44 includes an orifice 48 extending from the bottom of hollow bolt 46 to the bottom of the block 44. A shim 67 is placed between bearing 69 of the sheave 42 and the movable block 44 to assure that the sheave 42 does not rub against either the top of the movable block 44, or the top of the framework 62, or the top of the housing 77 of the helix control assembly 38.

Figures 2A, 2B, 2C:
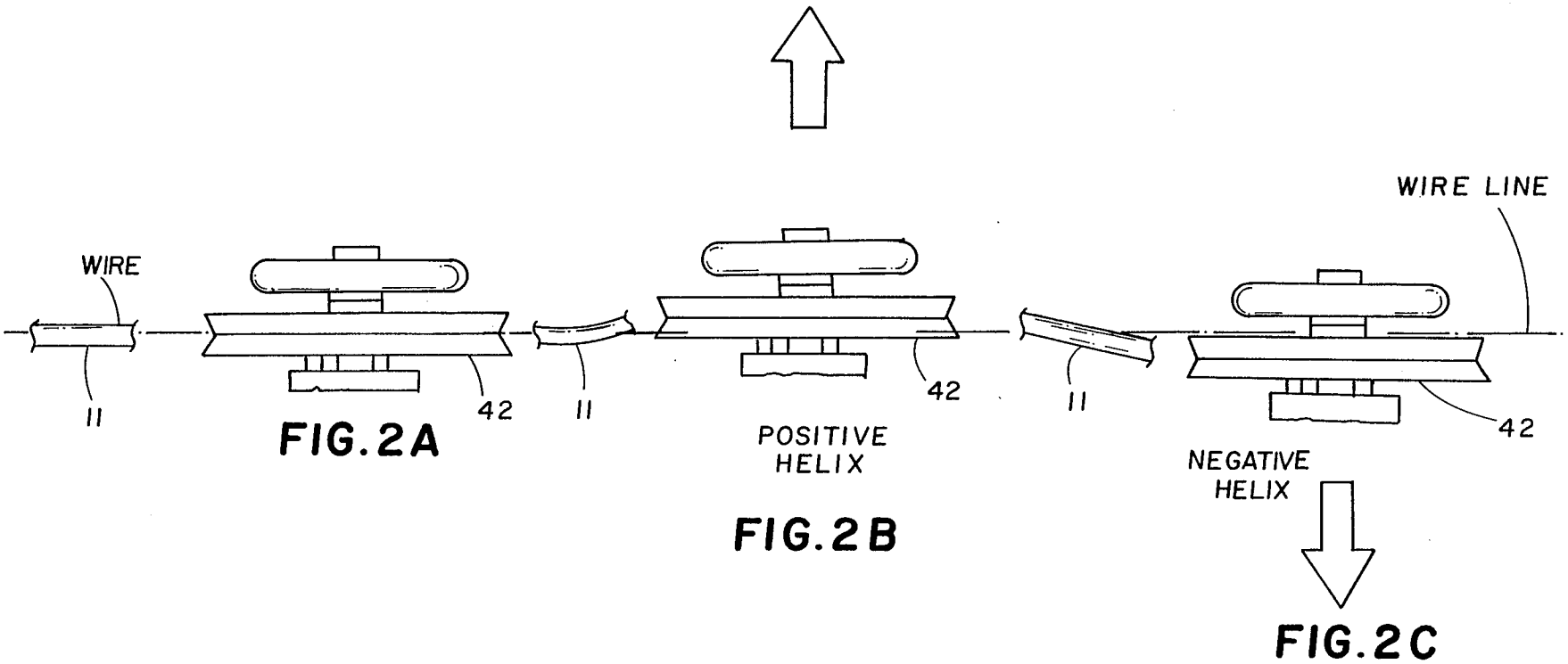
FIGS. 2A, 2B and 2C are schematic sequence views, showing (substantially) the extent of vertical adjustability of a sheave for imparting a "positive" or "negative" helix to the wire.

The wire 11 may be given a "positive" or "negative" helix, as shown schematically in FIG. 2A.

The selective adjustment means includes a threaded shaft 50, a handwheel 52 connected to the threaded shaft 50, a block 54 having threads complementary to the threaded shaft 50, and a threaded adjustment nut is located on the threaded shaft 50 below the stationary block 54. In a preferred embodiment, the assembly includes a pair of lock nuts 56 separated by a lock washer 56A, as shown more clearly in FIG. 3. However, other assemblies are equally feasible (such as threaded locking collars, not shown) consonant with the teachings of the present invention. The handwheel 52 is connected to the threaded shaft 50 and is capable of turning the shaft 50 when manually operated. The threaded shaft 50 passes through the hollow bolt 46, the sheave 42, the movable block 44, the adjustment nut 56, and the stationary block 54. By turning the handwheel 52, the threaded shaft 50 is selectively moved up or down with respect to stationary block 54. As the threaded shaft 50 moves upwardly, the lock nuts 56 push the sheave and movable block assembly upward. Or, as the threaded shaft 50 moves downward, the internally-threaded stationary block 54 causes the assembly to ride down. The extent of the downward movement of the assembly is limited by the engagement of the lower lock nut 56 with the top of the stationary internally-threaded block 54, thereby providing a stop means, so that the sheave 42 will not bottom out on the top surface of the guide blocks 65. When the sheave and block assembly moves up or down, the sheave 42 is selectively moved outside the first plane 36. A pair of outer stationary guide blocks 65 serve to guide the motion of the movable block 44 in a straight line.

Figure 4:
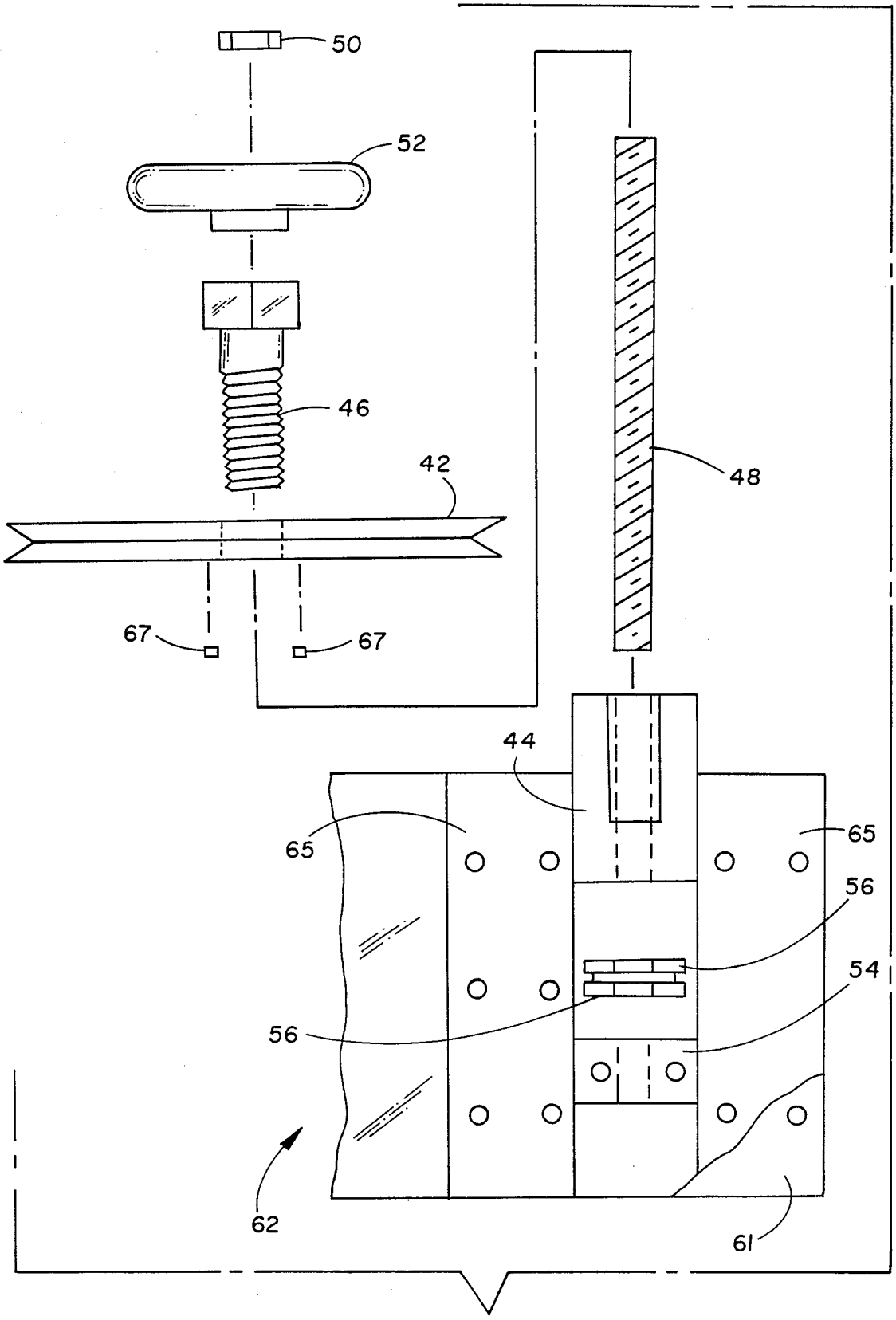
FIG. 4 is an exploded view of the helix control adjustment mechanism shown in FIG. 3.

In the view depicted in FIG. 4, the elements of the helical control assembly 38 shown in FIG. 3 are shown in exploded view.

In accordance with another aspect of the invention, as depicted in FIGS. 5-10, an apparatus for controlling the cast characteristic of wire is provided. The cast controlling apparatus includes a plurality of cast control rollers 28, 30, 32 and 34, a base plate 60 retaining the rollers, and a framework 62 supporting the base plate 60 and the rollers. The framework 62 includes a receiving plate 64 adapted to receive the base plate 60 therein. More specifically, the receiving plate 64 includes ledges 66 adapted to receive the base plate 60. The base plate 60 has three holes 60A for respective screws 60B that are received in corresponding tapped holes 66A in the ledges 66 of the receiving plate 64. The base plate 60 includes at least one adjustment screw 68 (and, preferably, two aligned adjusting screws 68A and 68B) lying in the plane of base plate 60, for adjusting at least one roller along the surface of the base plate 60. U-shaped clearance channels 64A are formed in the receiving plate 64 to accommodate the adjustment screws 68A and 68B. Adjustable cast rollers 30 and 34 are adjusted by adjustment screws 68 within slots 70. The receiving plate 64 includes at least one channel 72 in registration with the adjustment screw 68 wherein the channel 72 is capable of receiving means for turning the adjustment screw 68, when the base plate 60 is in position. An Allen wrench 74 is shown engaging an adjustment screw.

The framework 62 may be bolted onto a stationary support such as the support for the last drawing stage.

Figure 5:
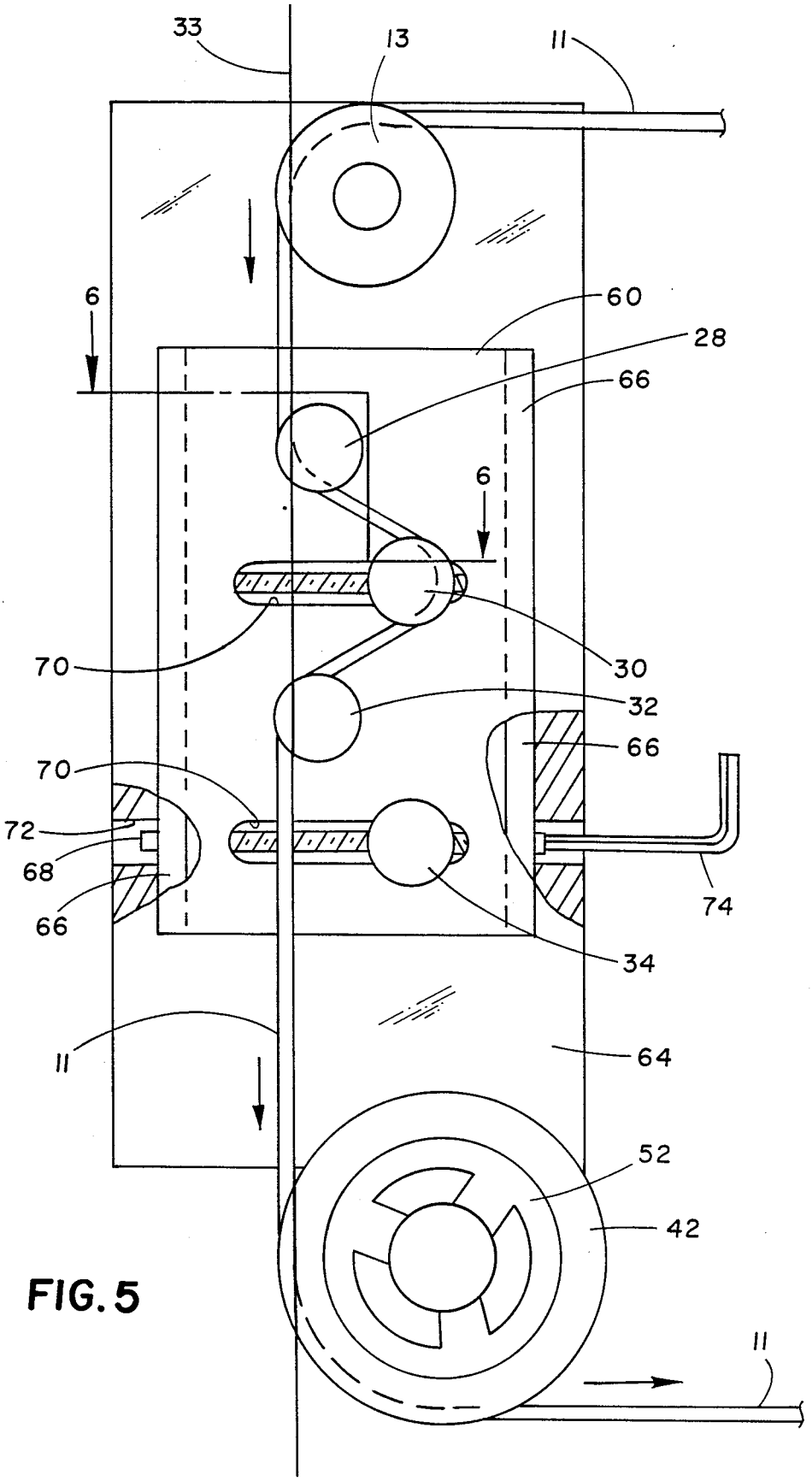
FIG. 5 is a close-up, top view of the apparatus shown in FIG. 2.

As shown in FIG. 5, a commonly utilized routing of wire 11 is as follows. The wire 11 comes from the wire source, e.g. drawing step 16 in FIG. 1, and takes a right angle turn on rotatable guide sheave 13. After passing stationary roller 28, the wire 11 is routed past adjustable roller 30. From adjustable roller 30, the wire 11 passes by stationary roller 32 and then into rotatable sheave 42 and onto the spool 20 of finish block 18 in FIG. 1. Adjustment of adjustable roller 30 is a key factor in control of cast. It is noted that in the routing of the wire 11 shown in FIG. 5, the roller 34 is not utilized.

Other wire routings are possible with the rollers shown in FIG. 5. For example, instead of using two stationary rollers 28, 32 and one adjustable roller 30, one may employ two adjustable rollers 30 and 34 and one stationary roller 32.

Preferably, the contact points (or tangent points) of the wire 11 with guide sheave 13, with stationary rollers 28 and 32, and with sheave 42 lie on a straight line 33 shown in FIG. 5, when viewed from above. However, when viewed from the side, as shown in FIG. 2, the portion of the wire 11 which contacts sheave 42 of the helix control assembly 38 lies in second plane 40 which is outside the first plane 36 wherein the contact points of the wire 11 guide sheave 13 and stationary rollers 28 and 32 are located.

Figure 6:
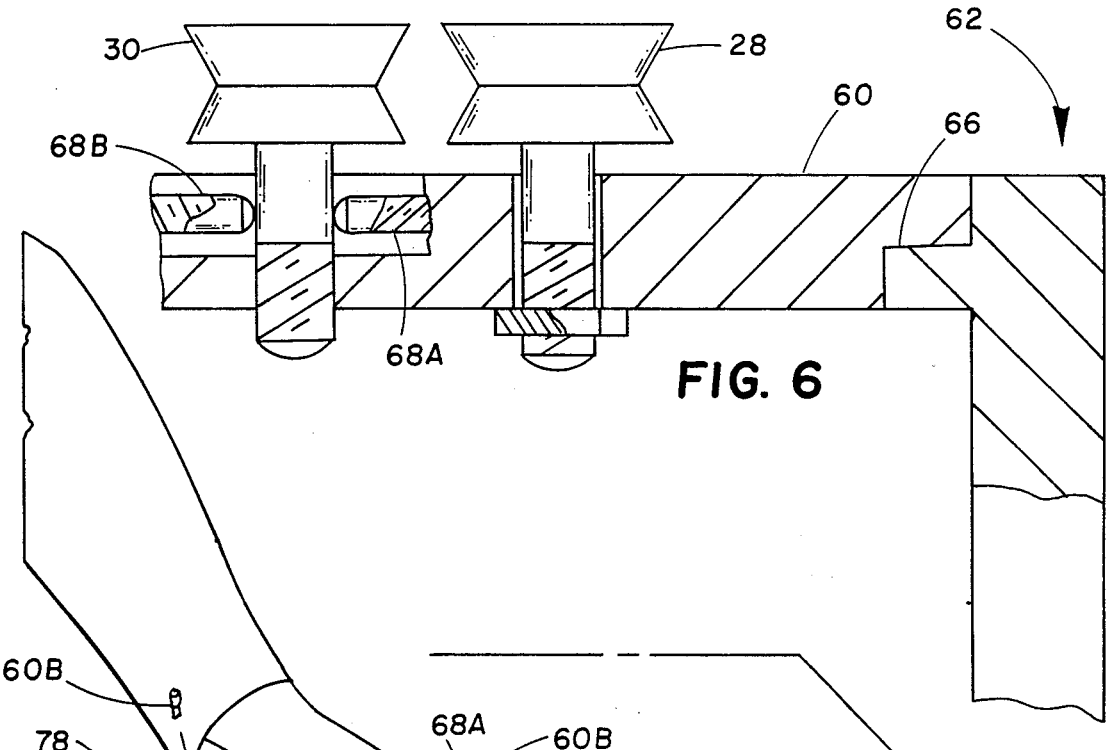
FIG. 6 is a cross-section of the apparatus in FIG. 5 taken along the line 6—6.

In FIG. 6, two adjustment screws 68 and 68*a* coming from opposite sides of the base 31 of roller 30 serve to secure roller 30 into an adjusted position. This structure provides back-up for the respective rollers and assures that the adjusted predetermined position of the respective rollers is maintained.

Figure 7:
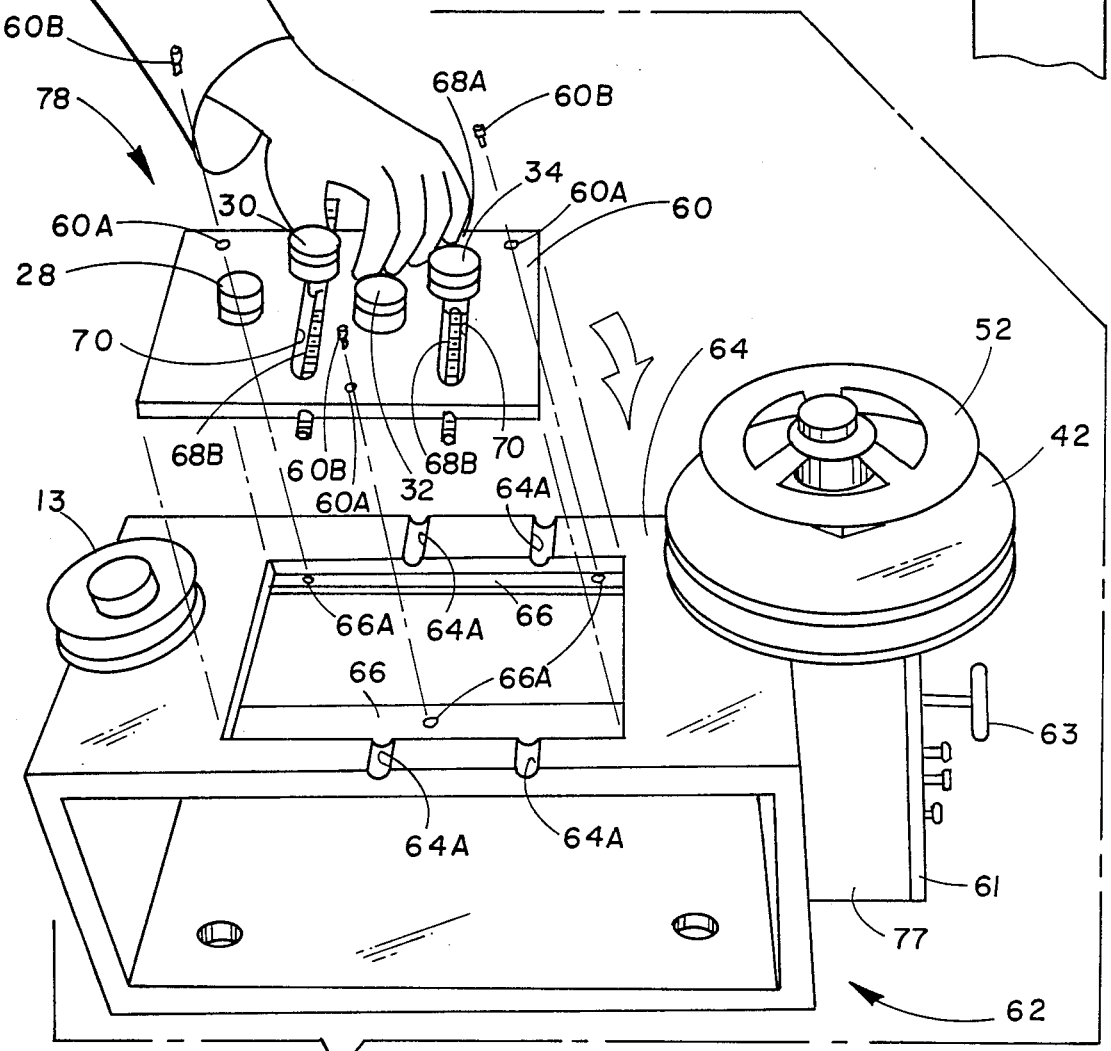
FIG. 7 shows an interchangeable roller assembly about to be placed in a framework support.
Figure 8:
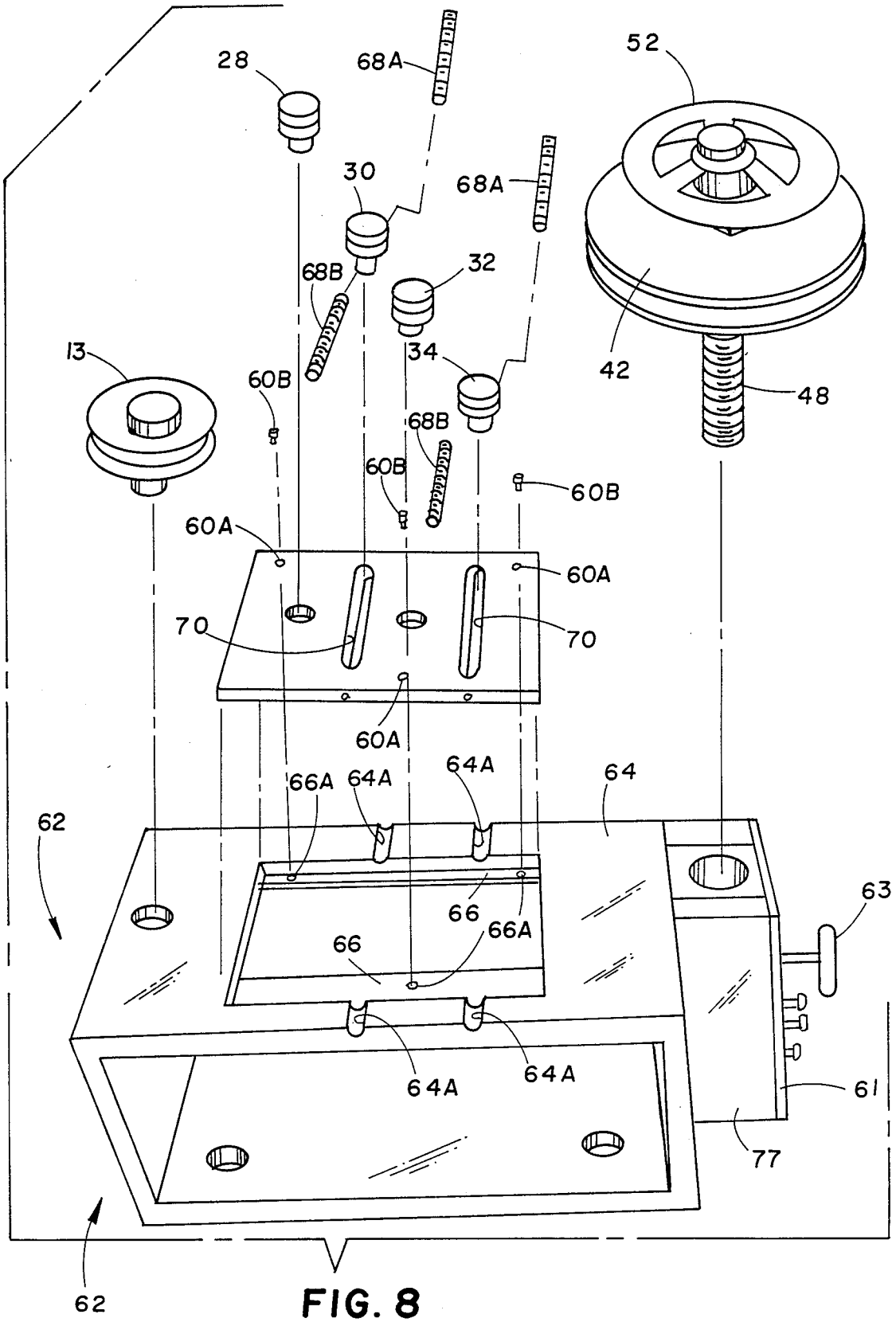
FIG. 8 is a partially exploded view of the apparatus shown in FIG. 7.

As shown in FIG. 7, a person is placing a casting roller assembly 78 onto the receiving plate 64 of the framework 62. The casting roller assembly 78 includes two stationary rollers 28 and 32 and two adjustable rollers 30 and 34. The base plate 60 has three openings 60A to receive respective screws 60B which are received in tapped holes 66A in the ledges 66 on the receiving plate 64. There are two screws 60B on one side of the base plate 60, and one screw 60B on the other side (intermediately of the two screws 60B on the one side, as shown more clearly in FIG. 7) thereby assuring proper alignment and positioning of the base plate 60.

Figure 9:
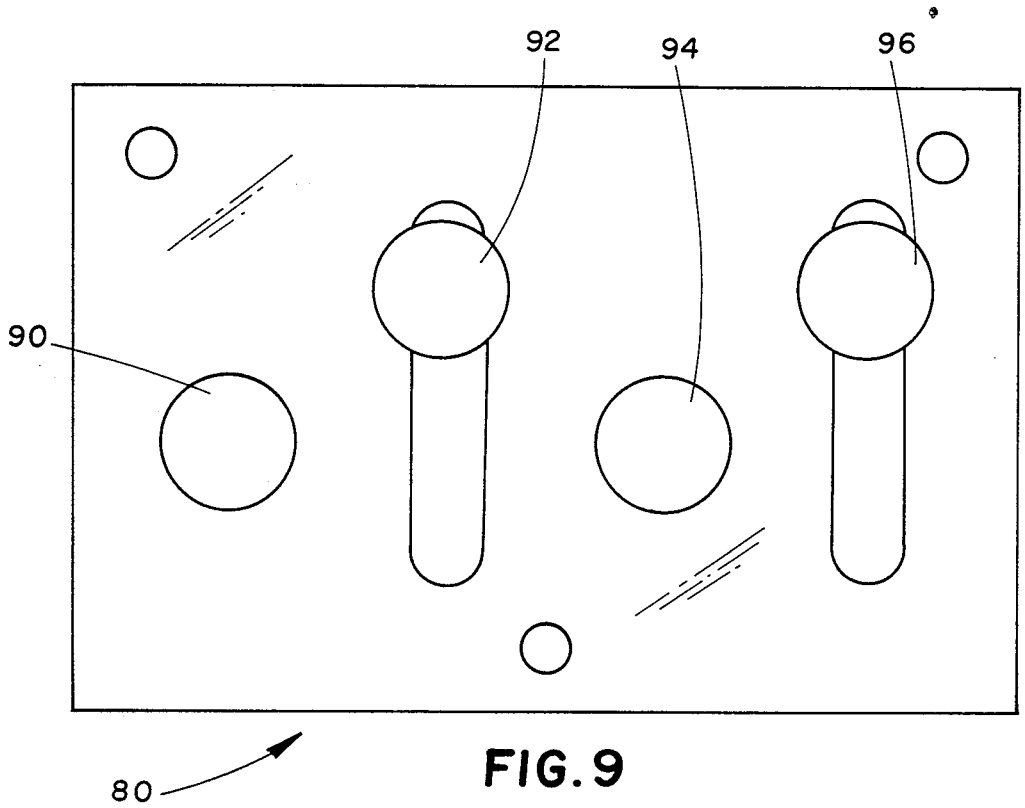
FIG. 9 and 10 depict alternate interchangeable roller assemblies.
Figure 10:
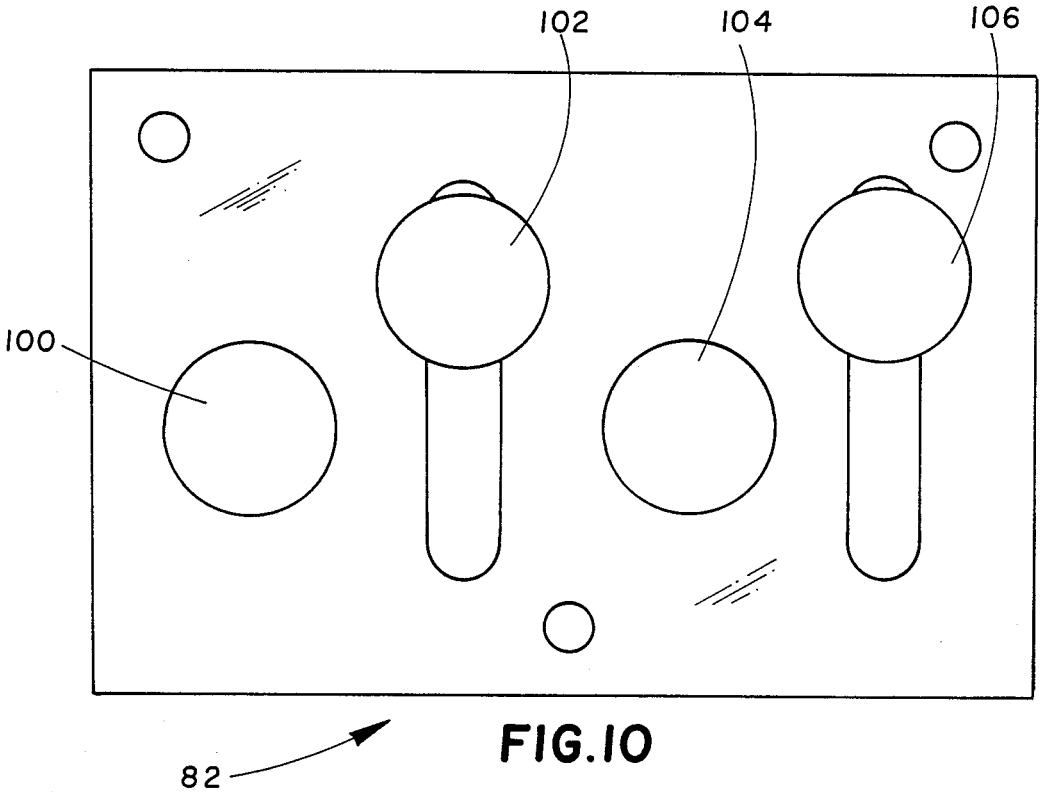

Additional casting roller assemblies 80 and 82 are shown in FIGS. 9 and 10, respectively. The rollers 28, 30, 32 and 34 in roller assembly 78 are of a different size than the rollers 90, 92, 94, and 96 in roller assembly 80 in FIG. 9. In addition, the rollers 100, 102, 104, and 106 in roller assembly 82 in FIG. 10 are of a different size that those in either of the roller assemblies 78 and 80. Yet, the size of the base plate for each of the roller assemblies 78, 80 and 82 is the same, thereby providing interchangeability.

It is noted that the size of the rollers, the spacing between the rollers, and the selected adjustments for the adjustable rollers can be fixed for each of the roller assemblies 78, 80 and 82. In this way, when different size wire or wire requiring different casting characteristics is required, one casting roller assembly can be swapped for another interchangeable roller assembly. The capability to swap interchangeable roller assemblies helps reduce time consuming and expensive trial and error when different cast characteristics are desired.

By employing the principles of the invention, numerous objects are realized and numerous benefits are obtained. For example, consistent helix control is provided for drawn wire, whereby scrap losses due to unsuccessful production runs are greatly reduced. Adjustment of the helix is obtained by a simple turning of a handwheel that controls a helix control assembly. By employing interchangeable sets of cast controlling rollers, much undesirable trial and error is eliminated when different wire cast characteristics are needed and different rollers are needed.

Figure 11:
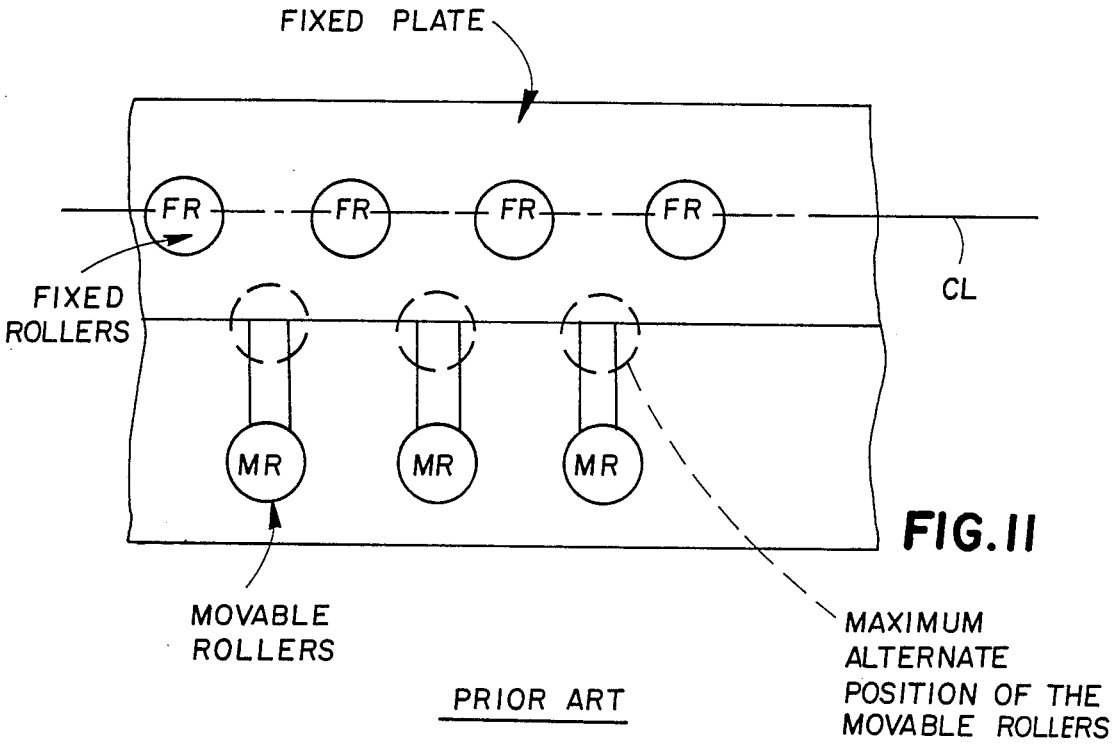
FIG. 11 PRIOR ART
FIG. 11 is a schematic drawing of a prior art base plate having a plurality of fixed rollers and further having a plurality of movable rollers interspersed between the fixed rollers, wherein the fixed rollers are disposed on a given centerline, and wherein the extent of movement of the movable rollers is limited and falls short of the center line of the fixed rollers.

With reference to FIG. 11, a prior art base plate BP is illustrated schematically, wherein a plurality of fixed rollers FR is disposed along a center line CL, and wherein a plurality of movable rollers MR is interspersed between the fixed rollers FR for movement transversely thereof. As will be readily appreciated, the maximum alternate position of the movable rollers MR falls short of the center line CL of the fixed rollers FR. As a result, the base plate BP with its fixed rollers FR and movable rollers MR do not have the desired flexibility for economical production.

Figure 12:
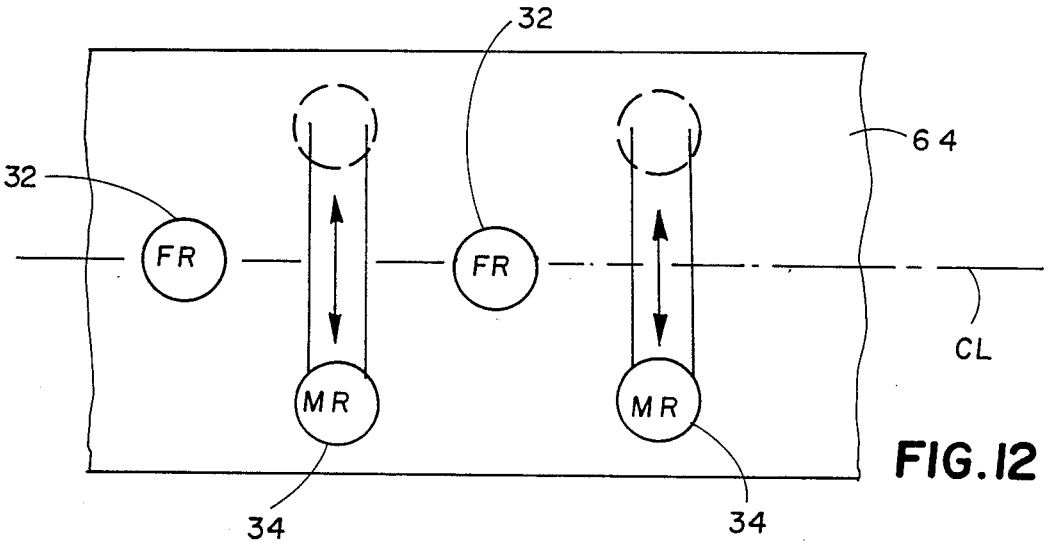
FIG. 12 is a further schematic drawing, corresponding substantially to that of FIG. 11, but showing an improvement of the present invention, wherein the movable rollers may selectively extend beyond the center line of the fixed rollers for substantially improved flexibility in production.

The improvement thereto is illustrated schematically in FIG. 12, wherein the movable rollers 34 are arranged to have alternate positions on either side of the center line CL. The result is increased flexibility for more economical production.

Obviously, many modifications may be made without departing from the basic spirit of the present invention. Accordingly, it will be appreciated by those skilled in the art that without the scope of the appended claims, the invention may be practiced other than has been specifically described herein.

What is claimed is:

1. An apparatus for controlling the helix characteristic of wire drawn from a wire source by means for pulling the wire, said apparatus comprising:
   - means, located between the wire source and the means for pulling the wire, for guiding the pulled wire along a path to alternately bend the wire in a first plane,
   - means, located between said guide means and the means for pulling the wire, for selectively exerting forces on the pulled wire, said forces being exerted on the pulled wire in a direction outside the first plane causing the wire to run on an angle, said force exerting means guiding the wire in a second plane which is parallel to said first plane.

2. An apparatus for positively controlling the helix characteristic of a wire drawn from a wire source by means for pulling the wire, said apparatus comprising:
   - means, located between the wire source and the means for pulling the wire, for guiding the pulled wire along a path to alternately bend the wire in a first plane,
   - means, located between said guide means and the means for pulling the wire, for selectively shifting the pulled wire from the first plane to a second plane which is parallel to said first plane causing the wire to run on an angle, whereby the helix characteristic of the wires is selectively controlled.

3. The apparatus described in claim 2 wherein said plane shifting means include means for manually adjusting and locking the shift from the first plane to the second plane.

4. The apparatus described in claim 2 wherein said guide means include means for selectively imparting a cast to the wire.

5. The apparatus described in claim 2 wherein said plane shifting means includes a rotatable sheave connected to an adjustable shaft, said plane shifting sheave including means for guiding the pulled wire in a selected second plane.

6. The apparatus described in claim 5 wherein said adjustable shaft is manually adjustable.

7. The apparatus described in claim 2 wherein said plane shifting means include an assembly comprised of a sheave and a movable block.

8. The apparatus described in claim 2 wherein said plane shifting means includes:
   - an assembly comprised of a sheave and a movable block, and
   - means for selectively adjusting the location of said assembly.

9. The apparatus described in claim 2 wherein said means for selectively shifting the pulled wire from the first plane to the second plane is adjustable, thereby causing the wire to be deflected at an adjustable degree of angle either above or below the first plane.

10. The apparatus described in claim 9 wherein said adjustable angle is lockable at a selected angle.

11. The apparatus described in claim 7 wherein said movable block is adjustable in two directions for obtaining either positive helix adjustment or negative helix adjustment.

12. The apparatus described in claim 11 wherein said movable block is adjustable manually.

13. The apparatus described in claim 8 wherein said sheave and block assembly is adjusted to cause the wire to run at a degree of angle to achieve predetermined specifications of helix quickly, accurately, and reproducibly.

14. An apparatus for controlling the helix characteristic of wire drawn from a wire source by means for pulling the wire, said apparatus comprising:

means, located between the wire source and the means for pulling the wire, for guiding the pulled wire in a first plane, means, located between said guide means and the means for pulling the wire, for selectively shifting the pulled wire from the first plane to a second plane, whereby the helix characteristic of the wire is selectively controlled, wherein said plane shifting means include an assembly comprised of a sheave and a movable block, wherein said assembly is comprised of:

a sheave including means for guiding the pulled wire in a selected second plane, said sheave further including an opening oriented substantially perpendicular to the second plane, a movable block supporting said sheave, said movable block including an opening aligned with the opening in said sheave, means for guiding the movement of said movable block, a fastener passing through the opening in said sheave and the opening in said movable block for fixing said sheave to said movable block.

15. The apparatus of claim 14 wherein the first plane is parallel to the second plane.

16. An apparatus for controlling the helix characteristic of wire drawn from a wire source by means for pulling the wire, said apparatus comprising:

means, located between the wire source and the means for pulling the wire, for guiding the pulled wire in a first plane, means, located between said guide means and the means for pulling the wire, for selectively shifting the pulled wire from the first plane to a second plane which is parallel to said first plane, whereby the helix characteristic of the wire is selectively controlled, wherein said plane shifting means includes:

an assembly comprised of a sheave and a movable block, and means for selectively adjusting the location of said assembly, wherein:

said assembly includes a hollow bolt securing said sheave to said movable block and said movable block includes an orifice extending from said hollow bolt to the bottom of said movable block, said selective adjustment means include, a threaded shaft, a handwheel connected to said threaded shaft, a stationary block having threads complementary to said threaded shaft, and a threaded adjustment nut located on said threaded shaft below said movable block, wherein said handwheel is connected to said threaded shaft and is capable of turning said shaft, and wherein said threaded shaft passes through said hollow bolt, said sheave, said movable block, said adjustment nut, and said stationary block, whereby by turning said handwheel said threaded shaft is selectively moved up or down with respect to said stationary block, and said adjustment nut respectively pushes said assembly up or permits said assembly to ride down, whereby said sheave is selectively moved outside the first plane.

17. An apparatus for controlling the cast and the helix characteristics of wire drawn from a wire source by means for pulling the wire, said apparatus comprising:

means, located between the wire source and the means for pulling the wire, for guiding the pulled wire in a first plane, said guide means including means for selectively imparting a cast to the wire by alternately bending the wire along a path in said first plane, means, located between said guide means and the means for pulling the wire, for selectively shifting the pulled wire from the first plane to a second plane parallel to said first plane causing the wire to run on an angle, whereby the helix characteristic of the wire is selectively controlled.

18. The apparatus described in claim 17 wherein said plane shifting means includes an assembly comprised of a sheave and a movable block and means for selectively adjusting the location of said assembly, thus causing an angled deflection of the wire selectively either positively or negative with respect to the first plane.

19. The apparatus described in claim 17 wherein said means for selectively shifting the pulled wire from the first plane to the second plane is adjustable, thereby causing the wire to be deflected at an adjustable degree of angle either above or below the first plane.

20. The apparatus described in claim 19 wherein said adjustable angle is lockable at a selected angle.

21. An apparatus for controlling the cast and the helix characteristics of wire drawn from a wire source by means for pulling the wire, said apparatus comprising:

means, located between the wire source and the means for pulling the wire, the guiding the pulled wire in a first plane, said guide means including means for selectively imparting a cast to the wire, means, located between said guide means and the means for pulling the wire, the selectively shifting the pulled wire from the first plane to a second plane, whereby the helix characteristic of the wire is selectively controlled, wherein said plane shifting means includes an assembly comprised of a sheave and a movable block and means for selectively adjusting the location of said assembly, further including a shim placed between said sheave and said movable block to provide clearance between said sheave and said movable block.

22. An apparatus for controlling the cast and the helix characteristics of wire drawn from a wire source by means for pulling the wire, said apparatus comprising:

a plurality of cast control rollers, located between the wire source and the means for pulling the wire, for guiding the pulled wire in a first plane and for selectively imparting a cast to the wire, a base plate retaining said rollers, a framework supporting said base plate and said rollers, aid framework including a receiving plate including ledges adapted to receive said base plate therein, means, located between said rollers and the means for pulling the wire and attached to said framework, for selectively shifting the pulled wire from the first plane to a second plane, whereby the helix characteristic of the wire is selectively controlled.

23. An apparatus for controlling the cast and the helix characteristics of wire drawn from a wire source by means for pulling the wire, said apparatus comprising:

means, located between the wire source and the means for pulling the wire, for guiding the pulled wire in a first plane, said guide means including means for selectively imparting a cast to the wire, means, located between said guide means and the means for pulling the wire, for selectively shifting the pulled wire from the first plane to a second plane, whereby the helix characteristic of the wire is selectively controlled, said plane shifting means including an assembly comprised of a sheave and a movable block and means for selectively adjusting the location of said assembly, wherein:

said assembly includes a hollow bolt securing said sheave to said movable block, and said movable block includes an orifice extending from said hollow bolt to the bottom of said movable block, said selective adjustment means include, a threaded shaft, a handwheel connected to said threaded shaft, a stationary block having threads complementary to said threaded shaft, and a threaded adjustment nut located on said threaded shaft below said movable block, wherein said handwheel is connected to said threaded shaft and is capable of turning said shaft, and wherein said threaded shaft passes through said hollow bolt, said sheave, said movable block, said adjustment nut, and said stationary block, whereby by turning said handwheel said threaded shaft is selectively moved up or down with respect to said stationary block, and said adjustment nut respectively pushes said assembly up or permits said assembly to ride down, whereby said sheave is selectively adjusted outside the first plane.

24. A method for controlling the helix characteristic of wire drawn from a wire source by means for pulling the wire, said method comprising the steps of:

guiding the wire in a first plane, alternately bending the wire along a path in said first plane and selectively exerting forces on the pulled wire which are in a direction outside the first plane into a second plane parallel to said first plane.

25. The method described in claim 14 wherein the forces exerted on the pulled wire outside the first plane are exerted at an angle either above or below the first plane.

26. A method for controlling the helix characteristic of wire drawn form a wire source by means for pulling the wire, said method comprising the steps of:

guiding the wire in a first plane, alternately bending the wire along a path in said first plane and selectively shifting the pulled wire from the first plane to a second plane parallel to said first plane, whereby the helix characteristic of the wire is selectively controlled.

27. The method described in claim 26 wherein the pulled wire is selectively shifted outside the first plane at an angle either above or below the first plane.

28. A method for controlling the cast and the helix characteristics of wire drawn form a wire source by means for pulling the wire, said method comprising the steps of:

guiding the pulled wire in a first plane around a set of rollers to alternatively bend the wire in the first plane, thereby selectively imparting a cast to the wire, and selectively shifting the pulled wire from the first plane to a second plane, which is parallel to said first plane whereby the helix characteristic of the wire is selectively controlled.

29. The method described in claim 28 wherein the shifted, pulled wire is retained in the second plane.

30. In an apparatus for controlling the cast of a wire drawn from a wire source, wherein a plurality of rollers includes a first set of fixed rollers disposed substantially along a given center line, and further includes a second set of movable rollers disposed for selective movement towards and away from the center line of the fixed rollers transversely thereof, and wherein the movable rollers may be individually and selectively adjusted, the improvement wherein the movable rollers may be disposed on either side of the centerline of the fixed rollers, as desired, thereby assuring that the molecular structure of the wire may be broken down substantially, and thereby assuring that the wire will maintain its desired given cast, further including a frame having an opening therein, wherein the first and second sets of rollers are mounted on respective base plates, and wherein a selected one of the base plates is adapted to be received in the opening in the frame, thereby providing for reduced tooling costs and improved flexibility in production.

* * * * *